US007311804B2

(12) United States Patent
Breiten et al.

(10) Patent No.: US 7,311,804 B2
(45) Date of Patent: Dec. 25, 2007

(54) UNIVERSAL DOCTOR BLADE WITH INDICIA

(75) Inventors: John David Breiten, Rockton, IL (US); Markku Lemetyinen, Clifton Park, NY (US)

(73) Assignee: Metso Paper, Inc., Helsinki (FI)

( * ) Notice: Subject to any disclaimer, the term of this patent is extended or adjusted under 35 U.S.C. 154(b) by 406 days.

(21) Appl. No.: 10/815,179

(22) Filed: Mar. 31, 2004

(65) Prior Publication Data

US 2005/0217818 A1 Oct. 6, 2005

(51) Int. Cl.
*B31F 1/12* (2006.01)

(52) U.S. Cl. ..... 162/280; 162/281; 118/413; 118/414; 15/256.51; 15/256.5; 30/40.1

(58) Field of Classification Search ..... 162/280, 162/281; 118/413, 414; 15/256.51, 256.5; 30/40.1

See application file for complete search history.

(56) References Cited

U.S. PATENT DOCUMENTS

| | | | | |
|---|---|---|---|---|
| 519,553 | A | | 5/1894 | Rounds |
| 2,664,792 | A | | 1/1954 | Cook |
| 2,710,445 | A | * | 6/1955 | Fitzpatrick, Jr. ..... 30/40.1 |
| 3,529,315 | A | | 9/1970 | Dunlap et al. |
| 3,778,861 | A | | 12/1973 | Goodnow |
| 4,373,445 | A | | 2/1983 | Köbler |
| 4,895,071 | A | | 1/1990 | Benton |
| 5,138,740 | A | | 8/1992 | Goodnow et al. |
| 5,974,966 | A | | 11/1999 | Bruni |
| 6,068,272 | A | | 5/2000 | Eskelinen |
| 6,202,252 | B1 | | 3/2001 | Harrisson |
| 6,361,656 | B1 | | 3/2002 | Rata |
| 6,447,646 | B1 | | 9/2002 | Hassinen et al. |
| 6,651,303 | B1 | | 11/2003 | Toivanen et al. |
| 6,682,012 | B1 | | 1/2004 | Parviainen et al. |

(Continued)

FOREIGN PATENT DOCUMENTS

DE 299 13 598 U1 11/1999

(Continued)

OTHER PUBLICATIONS

"ValEco Valmet doctor blade" product flyer, Metso Paper, Inc.

(Continued)

*Primary Examiner*—Mark Halpern
(74) *Attorney, Agent, or Firm*—Stiennon & Stiennon

(57) ABSTRACT

Doctor blades are provided for multiple positions within a paper or board making machine. A single doctor blade of a standard length or a reel of doctor blade material has markings which permit a variety of doctor blade sizes to be readily cut. If a standard length doctor blade is used, the length of the blade is chosen to be at least as long as the longest doctor blade required for a particular papermaking machine. If the material is in a reel, the markings may be at regular numbered intervals. If a pattern of rivets is connected to the blade, and the rivets must have a given relationship with a blade holder, blade length may be marked out in such a way that some blade material is discarded in order to position the rivets when shorter blades are cut from the blade reel.

9 Claims, 2 Drawing Sheets

U.S. PATENT DOCUMENTS

| | | | |
|---|---|---|---|
| 2001/0035070 | A1 | 11/2001 | Toivanen et al. |
| 2001/0052401 | A1 | 12/2001 | Kirjava et al. |
| 2004/0054608 | A1 | 3/2004 | Liiri et al. |

FOREIGN PATENT DOCUMENTS

| | | | |
|---|---|---|---|
| EP | 1 078 127 | B1 | 2/2004 |
| FI | 20002830 | | 12/2000 |
| FI | 111865 | B | 9/2003 |
| WO | WO 99/45197 | A1 | 9/1999 |
| WO | WO 99/60207 | * | 11/1999 |
| WO | WO 00/15904 | A1 | 3/2000 |
| WO | WO 02/099189 | A1 | 12/2002 |
| WO | WO 03/052649 | | 6/2003 |

OTHER PUBLICATIONS

"ValEco Valmet doctor blade" product flyer, Metso Paper, Inc., date unknown.

* cited by examiner

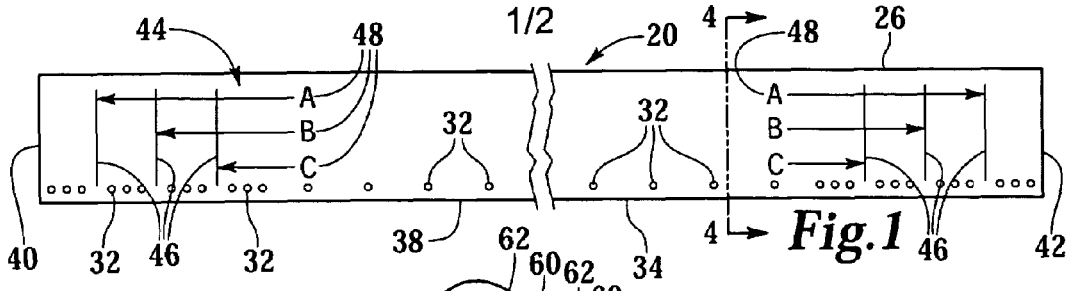
Fig.1
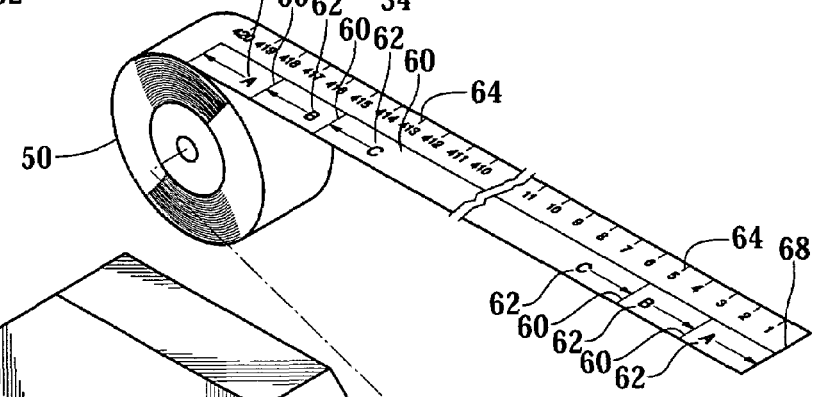
Fig.2
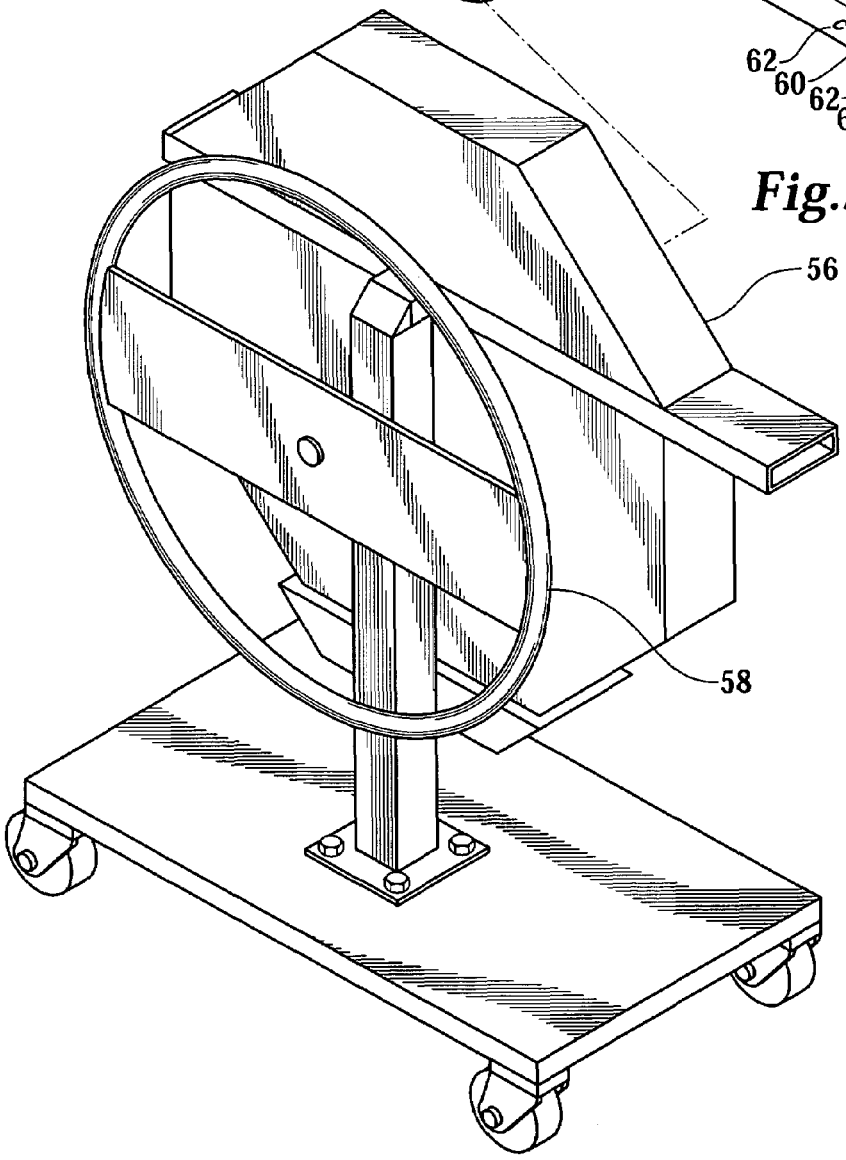

UNIVERSAL DOCTOR BLADE WITH INDICIA

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to doctor blades used with a tissuemaking, papermaking, or boardmaking machine, and to systems for minimizing doctor blade inventory associated with a tissuemaking, papermaking or boardmaking machine.

Doctor blades are used throughout a papermaking machine. Sometimes doctor blades are used to clean the surface of a roll used within a papermaking machine, for example press rolls, drying cylinders, and idler rolls. Doctor blades also function to prevent the paper web from becoming wrapped around a roll surface over which the paper web makes direct contact. Doctor blades function during a web break to remove broke from the surface of a roll and direct the broke into a broke pit for recycling. Doctor blades are also used to crepe a paper web and remove it from a Yankee dryer roll. In the past doctor blades of different materials have been used in different locations within a papermaking machine. The environment and conditions to which a doctor blade is subject depends dramatically on where the doctor blade is used in the papermaking machine. In the wet end, doctor blades may be subjected to corrosive effects due to chemicals dissolved or suspended in the white water. In the dry end a doctor blade may be subject to high temperatures associated with the drying process. In other locations wear may be a concern.

Doctor blades used in different parts of a papermaking machine are typically also of different lengths in the cross machine direction. The doctor blades differ in the length because as the paper web travels through the papermaking machine the paper shrinks in the cross machine direction and the edges are trimmed away such that the width of the paper web in the cross machine direction decreases as the paper web approaches the reel-up at the end of the papermaking machine. In addition, within a single papermaking plant there may be a number of different papermaking machines which have different widths. Moreover, the one plant may also include paper converting machinery such as slitters which create and handle paper which is substantially narrower than the width at which the paper web is manufactured.

Doctor blade material can be suppled to the paper mill as a blade cut to a particular length or as a coil of blade material which may be used as one continuous blade or as a series of identical blades which can be broken apart at labels positioned along the coil, the labels on the reel of blade material typically indicating the blade type and number of blades remaining in the coil. If a blade coil is used it may be packaged as shown is U.S. Pat. No. 6,068,272.

The combination of doctor blades of different material and different widths means that a papermaking machine requires a substantial inventory of different blade types and lengths. Depending on the application, a doctor blade may need to be changed as often as every day or as infrequently as once a year. If a proper doctor blade is not available the papermaking machine is not operated. To be sure the papermaking machine is not out of production for want of the necessary doctor blades, a relatively large inventory of doctor blades must be maintained. Because of the very high cost associated with keeping a papermaking machine out of production, the blade inventory system must err on the side of having too many, rather than too few, blades in the inventory. If the number of different doctor blades which are needed for a particular papermaking machine could be reduced, a substantial cost savings could be effected.

New doctor blade materials such as fiber reinforcement vinylesterurethanes or polyether amides may allow doctor blades constructed of the same material to be used in multiple locations throughout a papermaking machine, however this will not substantially reduce doctor blade inventory unless a way can be found to use identical doctor blades throughout a papermaking machine.

SUMMARY OF THE INVENTION

The doctor blade system of this invention employs a single doctor blade of a standard length or a reel of doctor blade material. The standard length doctor blade or the reel of doctor blade material is cut to length based on markings on the standard doctor blade or on the reel of doctor blade material which indicates the necessary blade length for a particular location.

If a standard length doctor blade is used, the length of the blade is chosen to be at least as long as the longest doctor blade required for a particular papermaking machine or within a particular paper mill. The blade is marked so it may readily be cut to length without measurement for use in locations where a shorter doctor blade is required. The marks may be simple spaced apart lines with sufficient indicia, so that proper blade length can be chosen with the help of a written manual or written instructions, which from a type of data base. Alternatively, the instructions may be printed as indicia on the blade itself. Such indicia may indicate blade length, or the correspondence of particular marks to particular doctor blade stations within the papermaking machine.

If a reel of doctor blade material is used, the indicia may be as simple as markings like a tape measure which in combination with instructions will allow the determination of the proper length of the doctor blade for a particular location. Alternatively, if a pattern of rivets forms part of the blade, and the rivets must have a given relationship with a blade holder, blade length may be marked out in such a way that some blade material is discarded in order to position the rivets when shorter blades are cut from the blade reel.

It is a feature of the present invention to provide a doctor blade which can replace many doctor blades used in the papermaking machine.

It is a further feature of the present invention to provide a doctor blade which is marked so as to facilitate cutting the doctor blade to an appropriate size for a particular location within the papermaking machine.

It is another feature of the present invention to provide a doctor blade and doctor blade inventory system which minimizes the number of doctor blades which must be maintained in a papermaking mill inventory.

It is yet another feature of the present invention to provide a doctor blade reel which incorporates a means for cutting the doctor blade to a selected length in cooperation with information recorded on the doctor blade.

Further features and advantages of the invention will be apparent from the following detailed description when taken in conjunction with the accompanying drawings.

BRIEF DESCRIPTION OF THE DRAWINGS

FIG. 1 is a fragmentary top plan view of the doctor blade of this invention.

FIG. 2 is an exploded isometric view of a reel of doctor blade material in a doctor blade case.

DESCRIPTION OF THE PREFERRED EMBODIMENTS

Figure 5:
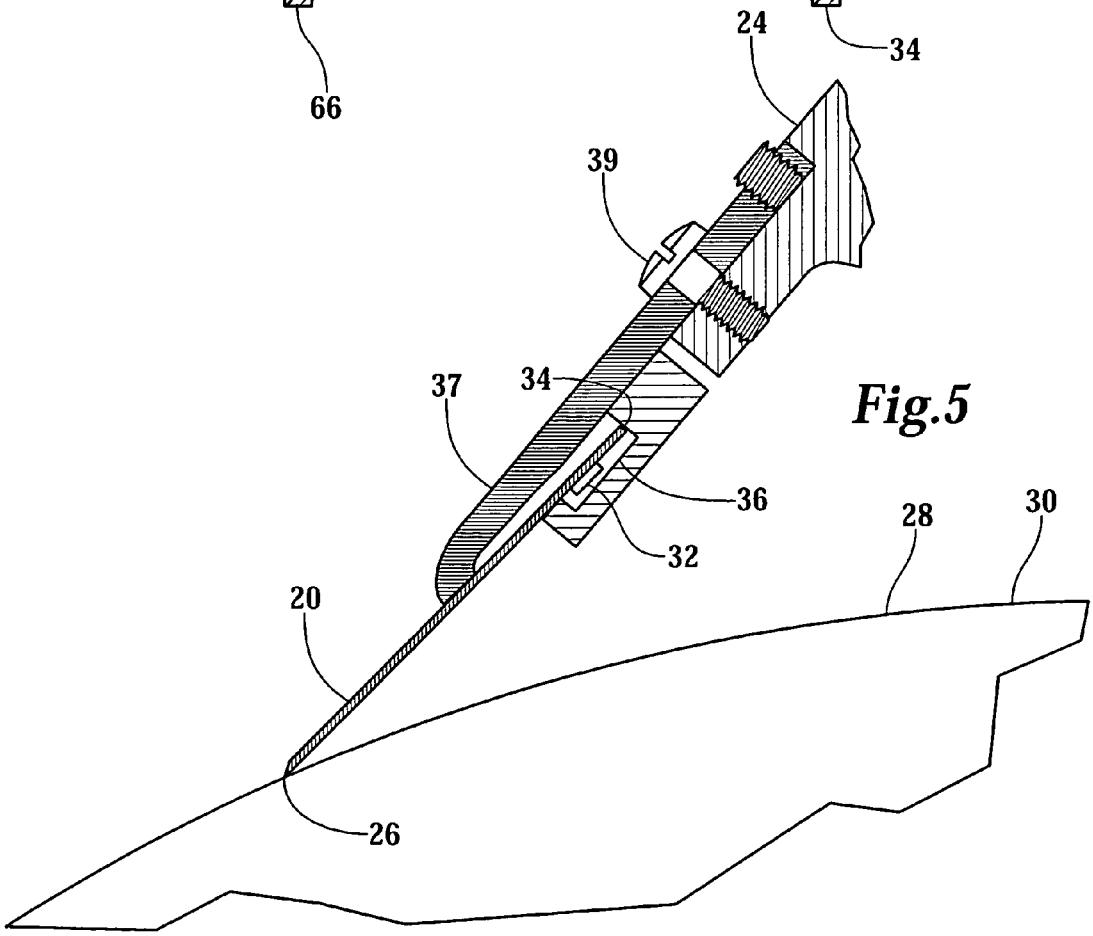
FIG. 5 is cross-sectional view of the doctor blade of FIG. 3 held in a doctoring position against a roll by a blade holder.

Referring more particularly to FIGS. 1-4 wherein like numbers refer to similar parts, a doctor blade 20 is shown in FIG. 1. The doctor blade 20 is preferably constructed of fiber reinforced plastic, for example vinylesterurethanes or polyether amides reinforced with graphite fibers. Such recently developed doctor blades are capable of functioning in many or all locations within a papermaking machine. As shown in FIG. 5, the doctor blade 20 has an edge 26 which is beveled and which is mounted to a doctor blade support 24 so that the edge 26 is held against the surface 28 of a roll 30.

As shown in FIG. 1, the doctor blade 20 has a plurality of rivets 32 arranged along an edge 34 opposite the beveled edge 26. The rivets may be spaced as shown, or for example, in groups of three every eighteen inches. As shown in FIG. 5, the rivets 32 provide a protrusion which is positioned within a channel or groove 36 formed in a doctor blade holder 37. The doctor blade 20 is retained by the doctor blade holder 37 which is clamped by a bolts 39 to a doctor blade support 24. As shown in FIG. 1, the rivets 32 can be widely spaced in a middle portion 38 of the blade 20. The rivets 32 however should be more closely spaced at the ends 40, 42 of the doctor blade 20. In particular, in order that the doctor blade ends 40, 42 are adequately supported, it is important for a rivet 32 to be positioned closely spaced, for example less than six inches, from either of the ends 40, 42. The doctor blade 20 shown in FIG. 1 is sized such that the overall length of the blade from one end 40 to the other end 42 is sufficient for the widest portion of the papermaking machine. Indicia 44 is printed or formed on the blade 20 directly or on a label which is placed on the blade 20. The Indicia 44 shows a cut line 46 which is indicated by a label 48. Spaced apart cut lines 46 with similar or identical labels 48 indicate how the blade should be cut to produce doctor blades 20 of varying widths. The cut lines 46 define cut locations, i.e., positions where the blade can be cut. The blade 20 illustrated in FIG. 1 can be used without being cut; can be cut to the cut lines indicated on each end by labels A, A; cut to the cut lines B, B; or cut to the cut lines C, C. Thus the same basic doctor blade can be used to form a doctor blade for four different locations. The rivets 32 are arranged so that one or more rivets is closely spaced from either of the ends 40, 42 or from a pair of cut lines 46.

By providing additional cutlines and suitable indicia, a doctor blade can be formed according to any preselected desired length from the standard or maximal length doctor blade. The doctor blade 20 could also have indicia simply indicating a number line, such as found on a tape measure, and instructions could be provided as to the difference between numbers indicating cut lines which correspond to a particular blade width. If an array of tape-measure-type indicia cut lines is printed, it will be desirable that the cut line pattern be regular. More particularly, in such a case, the rivets should have a fixed relation to particular indicia numbers, so that a doctor blade of a selected length can be cut in reference to particular indicia and rivets will be properly positioned with respect to the ends of the doctor of the selected length. This may be arranged for example by having the rivets spaced evenly along the number line e.g. at every mark or number or ever fourth mark, and cutting doctor blades of even lengths so the rivets are properly spaced. Alternatively, some indicia may be provided which indicates which numbers are properly positioned with respect to a rivet so that cutting at a selected number will produce an end properly positioned with respect to a rivet. This arrangement in which a tape-measure-like indicia of cut lines is printed upon the doctor blade will be described in more detail with respect to the reel of doctor blade material 50 illustrated in FIG. 2.

Figure 3:
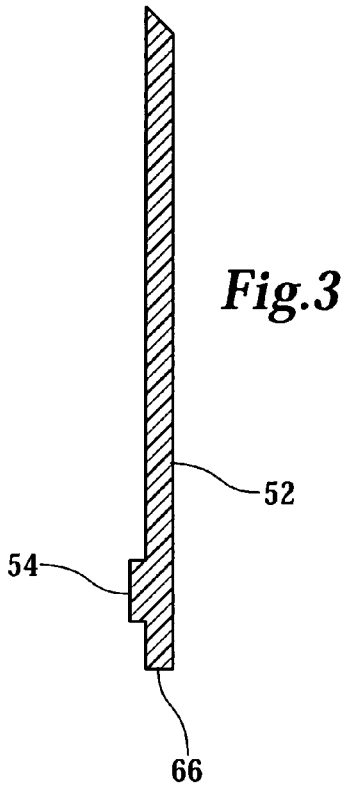
FIG. 3 is a cross-sectional view of the doctor blade of FIG. 1 taken along section line 3-3.
Figure 4:
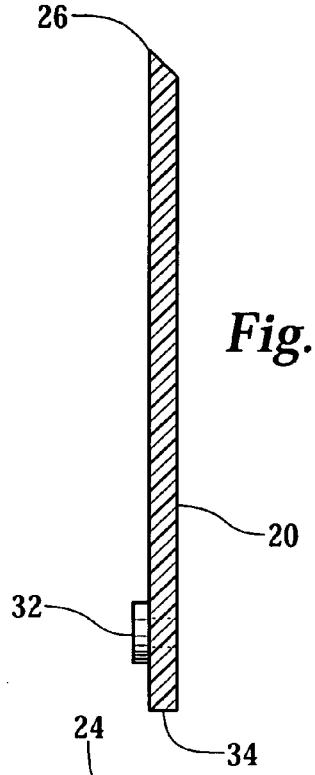
FIG. 4 is a cross-sectional view of an alternative embodiment fiber reinforced plastic doctor blade.

To avoid the necessity of taking into account the location of the rivets 32 when producing a doctor blade from the standard sized doctor blade 20, a doctor blade 52 with a cross-section as shown in FIG. 3 may be employed. The doctor blade 52 has a thicker portion or land 54 which is positioned to run along the blade 52 in place of the rivets 32. The land 54 serves the same function as the rivets 32 when positioned in the blade holder so that the land is held within the channel or groove 36.

A coil of doctor blade material 50 is shown in FIG. 2. The coil 50 is positioned within a transit case 56 mounted to an unreeling device 58 similar to the reel up device such as illustrated in U.S. Pat. No. 6,682,012 to Parviainen et al. which is incorporated herein by reference. The coil of the doctor blade 50 may have rivets 32, such as on the blade shown in FIG. 4, or may be formed with the land 54, as shown in FIG. 3. Where nonuniformly spaced rivets 32 are used cutlines 60 and indicia 62 similar to that shown in FIG. 1 may be marked upon the doctor blade 50. Each doctor blade cut from the coil of doctor blade material 50 which is smaller than the doctor blade indicated by A, A will necessarily have a certain amount of scrap. So a cut is always made at the cut line A, and, if the doctor blade is not to extend between A, A then additional cuts are made at each cutline B, or C.

The indicia described in the previous paragraph are related to each other to indicate cut locations spaced apart from one another for cutting the doctor blade body to predetermined lengths. An array of indicia 64 similar to that used on a tape measure could advantageously be used on the coil of doctor blade material 50, particularly where rivets are evenly spaced along one edge 34 of the blade, or where a land 54 is continuously in juxtaposition to a blade edge 66 as shown in FIG. 3. By using a number-line type of indicia 64, as shown in FIG. 2, doctor blades of varying lengths can be cut from the coil of doctor blade material 50 with little or no waste. The number line is used together with a table which indicates the length for each of a plurality of blades having different lengths. To cut a doctor of a set length the current end 68 of the coil of doctor blade material 50 is determined. For convenience the end may be trimmed to an exact indicated numeral. Then the number corresponding to the end 68 is added to the total desired doctor blade length and a cut is made at an indicia indicating the position along the doctor blade coil 50 corresponding to the sum of the current end indicia number and the desired doctor blade length. In this way, little or no doctor blade will go to waste.

It should be understood that a plurality of doctor blades lengths could be marked on a coil of doctor blade material or on a single doctor blade of fixed length. Where to cut the doctor blade material or doctor blade of fixed length to form a particular doctor blade of said plurality of doctor blades could be determined by indicia on the doctor blade alone or by reference to the indicia on the doctor blade and a database such as a printed instruction sheet. The database provides a correlation between a desired length of doctor blade and the particular markings on the doctor blade material to provide instructions to cut the doctor blade from the material. For example, the database might indicate that to obtain a doctor blade of a desired length it is necessary to cut at the third marking in from the left side of the doctor blade material, and the second marking in from the right side. The database may also be maintained in electronic form. In the preferred embodiment illustrated in FIG. 1, the database is incorporated in the indicia marked on the doctor blade by providing the designators "A" "B" "C" on corresponding markings to show which cut lines go together to define a doctor blade of a certain length. Additional data can be provided in the indicia, such as identifying words, numbers or part names in relationship to particular cut lines.

It should be understood that the doctor blade material could be cut automatically or by hand using a shear or a saw blade, such as a hacksaw. The shear or saw may be mounted to the reeling device 58, to the transit case 56, to a papermaking machine (not shown), or to some other equipment. Where a cut is to be made could be determined visually by an operator or automatically by an optical, magnetic or other type of sensor.

It should be noted that the indicia may operate together with an initial end of the blade body to define multiple lengths of blade body for forming different length doctor blades. In such a situation, the initial end, or cut end 40, 68 of the blade body, defines one end of the doctor blade to be cut, and indicia marked on the blade body define multiple cut lines spaced a defined distance from the initial end.

It should be understood that where a papermaking machine is referred to, a boardmaking, or tissuemaking machine, or a paper or board calendar is also intended. It should be understood that "indicia" as used in the claims is meant to include printing, a label with or without printing, scribing or other markings on the blade material, machine readable codes such as bar codes, magnetic codes, or radio-frequency identification devices (RFID).

It should be understood that a doctor blade or a coil of doctor blade material, as used herein has a thickness of at least 0.030 inches, a width of at least 1.5 inches and a length of at least 96 inches.

It should be understood that the term rivets is defined to include any similar structures including any protrusion extending from a doctor blade as may be formed by bonding to the doctor blade, punching, or folding a part of the doctor blade.

It is understood that the invention is not limited to the particular construction and arrangement of parts herein illustrated and described, but embraces all such modified forms thereof as come within the scope of the following claims.

We claim:

1. An elongated doctor blade body and database for constructing one of a plurality of doctor blades of different lengths from the single doctor blade body, so that the single doctor blade body contains the plurality of doctor blades as overlapping portions of said single doctor blade body, the elongated doctor blade body and database comprising:

a database containing instructions for cutting each of said plurality of doctor blades from the doctor blade body; and wherein the doctor blade body has a plurality of indicia marked thereon, such that the indicia and the database together delimit said plurality of doctor blades of different lengths as overlapping portions of the doctor blade body.

2. The elongated doctor blade body and database of claim 1 wherein the database is incorporated in the plurality of indicia.

3. The elongated doctor blade body and database of claim 1 wherein the database is separate from the plurality of indicia.

4. The elongated doctor blade body and database of claim 3 wherein the database is a writing.

5. The elongated doctor blade body and database of claim 1 wherein a first pair of indicia are spaced a first distance apart to define a first doctor blade length, and wherein a second pair of indicia defining a second doctor blade of length less than the first distance is positioned between the first pair of indicia, so that a second doctor blade is delimited from a portion of the doctor blade body defined by the first doctor blade length.

6. The elongated doctor blade body and database of claim 1 further comprising a plurality of rivets mounted to the doctor blade body, the rivets extending from the blade body, wherein the plurality of rivets are arranged so that each of the plurality of different doctor blade lengths defines a first end and a second end and one rivet of the plurality of rivets is positioned within a selected distance of each of said first ends and said second ends of each of the plurality of different doctor blade lengths.

7. The elongated doctor blade body and database of claim 1 wherein the indicia is in the form of a number line marked on said doctor blade body so that by means of the database a plurality of different overlapping lengths along the doctor blade body are determinable.

8. The elongated doctor blade body and database of claim 1 wherein the indicia includes marks which perform no other function but to delimit the plurality of doctor blades of different lengths.

9. The elongated doctor blade body and database of claim 1 wherein the plurality of indicia include a first pair of indicating points on said doctor blade body, delimiting a first doctor blade of a first length; and a second pair of indicating points on said doctor blade body delimiting a second doctor blade of a second length, the second length being less than the first length, wherein at least one of the first pair of indicating points and at least one of the second pair of indicating points is an initial end of the doctor blade body, and the indicating points which are not the initial end of the doctor blade body comprise the plurality of indicia on the doctor blade body.

* * * * *